United States Patent [19]

Moret et al.

[11] 4,416,025

[45] Nov. 22, 1983

[54] BIB HAVING SEGMENTED NECK-APERTURE PERIMETRIC EDGE

[75] Inventors: David M. Moret; Nicholas A. Ahr, both of Cincinnati, Ohio

[73] Assignee: The Procter & Gamble Company, Cincinnati, Ohio

[21] Appl. No.: 487,486

[22] Filed: Apr. 22, 1983

[51] Int. Cl.[3] ..... A41D 27/12

[52] U.S. Cl. ..... 2/49 R

[58] Field of Search ..... 2/49 R, 50, 51, 52

[56] References Cited

U.S. PATENT DOCUMENTS

| | | | |
|---|---|---|---|
| 2,622,246 | 12/1952 | Hufnagel | 2/49 R |
| 2,763,867 | 9/1956 | Chagwon | 2/49 R |
| 3,146,464 | 9/1964 | Burnett | 2/49 R |
| 3,328,807 | 7/1967 | Strauss | 2/49 R |
| 3,857,116 | 12/1974 | Meeker | 2/50 |
| 3,945,048 | 3/1976 | Shearer | 2/49 R |

*Primary Examiner*—Doris L. Troutman

*Attorney, Agent, or Firm*—Thomas J. Slone; Fredrick H. Braun; Richard C. Witte

[57] ABSTRACT

A bib having a neck-accommodating aperture defined by a segmented perimetric edge: i.e., a segmented neck-aperture perimeter. The neck-accommodating aperture is generally oval-shape and the sheet material from which the bib is constructed has a plurality of bifurcations such as slits or notches which extend generally radially outwardly from the perimetric edge of the neck-accommodating aperture. Each pair of adjacent bifurcations define a portion of bib material which is attached to the parent bib material along only a proximal-end-defining line and which portion is designated a petal. The petals are readily conformable to a range of neck sizes and will, due to inherent resilience of the bib material, maintain a comfortable fit even during infant neck contortions. In an exemplary embodiment, the distal end portions of such petals are doubled under and have their distal ends secured adjacent their proximal ends to obviate raw cut edges of such portions from contacting users' necks.

10 Claims, 9 Drawing Figures

BIB HAVING SEGMENTED NECK-APERTURE PERIMETRIC EDGE

DESCRIPTION

1. Technical Field

This invention pertains to providing bibs—preferably disposable bibs—for use on, for example, babies being fed. More specifically it pertains to such bibs having oval-shape neck-accommodating apertures which are defined at least in part by articulated portions of the bib material which are so configured and disposed adjacent such apertures that they conform to a range of neck sizes, and concomitantly precipitate increased wearer comfort. As used herein oval-shape is intended to be generic and to include but not be limited to elliptical-shape as well as circular-shape.

2. Background Art

Background art patents disclose neck accommodating means comprising a plurality of slits; and bibs wherein portions of the bib material are cut, folded back, and secured to provide neck openings. These provide neck openings without removal of bib material per se. U.S. Pat. No. 2,763,867 which issued Sept. 25, 1956 to Y. L. Chagnon, and U.S. Pat. No. 3,945,048 which issued Mar. 23, 1976 to Janet Shearer disclose multiple-slit type neck accommodating means; and U.S. Pat. No. 2,622,246 which issued Dec. 23, 1952 to J. P. Hufnagel, and U.S. Pat. 3,857,116 which issued Dec. 31, 1974 are representative of patents which disclose bibs having doubled back and secured portions of bib material disposed adjacent their neck openings, albeit not articulated portions disposed between radially extending slits or notches which have their distal ends secured adjacent their proximal ends as provided by the present invention. Additionally, U.S. Pat. No. 3,146,464 which issued Sept. 1, 1964 to E. N. Burnett, and U.S. Pat. No. 3,328,807 which issued July 4, 1967 to K. Strauss are representative of patents which disclose bibs wherein neck openings are defined by removable/removed panels of bib material.

DISCLOSURE OF THE INVENTION

In accordance with one aspect of the present invention a disposable bib of sheet material such as a laminate comprising a paper topsheet lamina and a thermoplastic backsheet lamina is provided which has a generally oval-shape neck-accommodating aperture defined by a segmented perimetric edge. The perimetric edge is segmented by virtue of a plurality of bifurcations such as slits or notches which extend radially outwardly from the perimetric edge. The radial bifurcations render the portions of the bib therebetween more conformant and compliant adjacent the neck-accommodating aperture than were the bifurcations not present. Such portions are designated petals. Additionally, the distal ends of the petals of the bib material disposed between adjacent bifurcations may be doubled back and secured to bib material disposed adjacent their respective proximal ends: preferably doubled under and so secured in place that most of the confronting surfaces of the petals are not secured together.

BRIEF DESCRIPTIONS OF THE DRAWINGS

While the specification concludes with claims which particularly point out and distinctly claim the subject matter regarded as forming the present invention, it is believed the invention will be better understood from the following description taken in conjunction with the accompanying drawings in which:

DETAILED DESCRIPTION OF THE INVENTION

Figure 1:
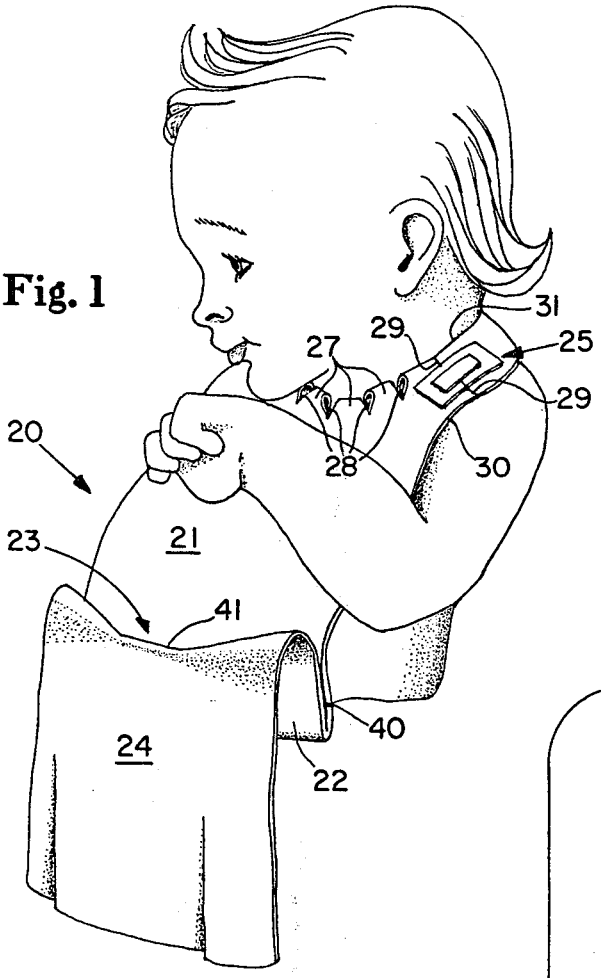
FIG. 1 is an in-use perspective view of a disposable bib which is in exemplary disposable bib embodiment of the present invention.

An exemplary bib which is a disposable embodiment of the present invention is designated 20 in FIG. 1. Bib 20 comprises top panel 21, pocket panel 22, a full-width pocket 23, and apron panel 24. As shown in FIG. 1, it has been fastened about the neck of a baby by fastening means 25 which may be a duplex tape-type fastener. Also, the region of top panel 21 disposed adjacent the frontal area of the baby's neck is shown to comprise a plurality of portions which are designated petals 27 each of which petals is bounded by two radially extending slits 28 which, in infant bibs, are preferably about three (3) centimeters or less in length. As shown in FIG. 1, the petals 27 are somewhat curved upward to conform to the baby's neck. Thus, the petals 27 an slits 28 constitute means for the bib to be fitted to a range of neck sizes due to the resilience and displaceability of the petals.

Briefly, bib 20, FIG. 1, is fitted on a baby by opening the tape fastener which bridges a slit 29 in the left shoulder region which slit extends from the edge of the neck-accommodating aperture to the left edge 30 of top panel 21. Then, after the bib is placed on the infant the left shoulder portions of the bib are brought together and secured in place with the tape fastener. Thus, the distal edges of the petals 27 corporately define the frontal portion of the perimetric edge 31 of the neck-accommodating aperture of the bib.

Figure 2:
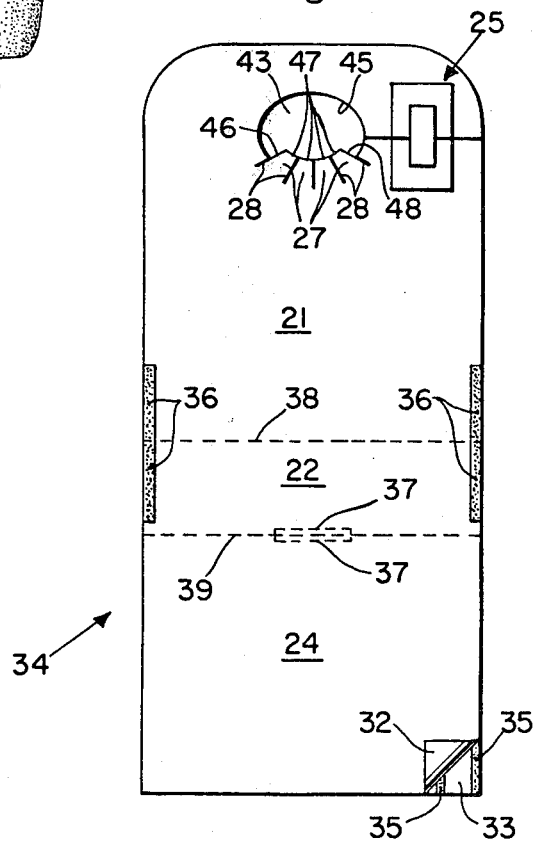
FIG. 2 is a plan view of a partially converted (i.e., partially manufactured) disposable bib which, when folded and seamed along the side edges of the pocket panel and along the frontal portion of the neck-accommodating aperture becomes a bib of the configuration shown in FIG. 1.

FIG. 2 is a plan view of a die-cut blank 34 from which the bib 20, FIG. 1, is converted. As shown in FIG. 2, the blank 34 comprises a laminate comprising a topsheet lamina 32 which is preferably a wet strength tissue paper having a basis weight of from about 16.3 to about 81.5 grams per square meter, and a backsheet lamina 33 which is preferably an impervious material such as a thermoplastic film: eg, polyethylene having a thickness of from about one-half mil to about one-and-one-half mils (ie, from about 0.0127 to about 0.0381 mm). Such laminates have sufficient inherent resilience that the above described petals will tend to conform to the necks of users albeit they are sufficiently easily so conformed that the reactive forces of such conforming do not precipitate undue user discomfort or irritation. The laminae 32 and 33 are preferably secured together by spaced apart areas of adhesive such as adhesive beads 35. Also as shown in FIG. 2, the shaded areas 36 on the front surface of the bib and shaded areas 37 on the back surface of the bib represent contact adhesive on the bib which when the blank is folded along lines 38 and 39, become adhered to form the side seams 40 of pocket 23, FIG. 1, and the central fin seam 41 along the top edge of pocket 23, FIG. 1, respectively.

Figure 3:
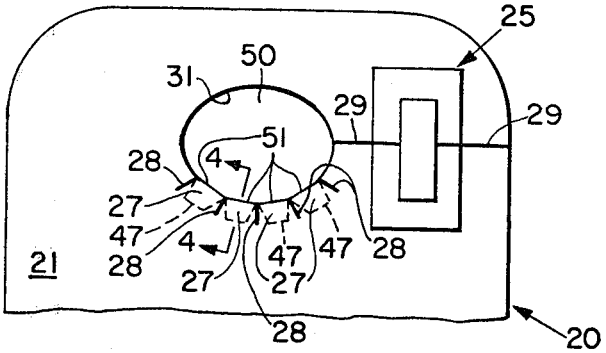
FIG. 3 is a fragmentary plan view of the upper portion of the disposable bib of FIG. 1.

Still referring to FIG. 2, an opening 43 has been provided by removing a portion of the bib material. Opening 43 is defined by edge segments 45 through 48, inclusive. Radial slits 28 are provided to subdivide the bib material in the frontal region of opening 43 into four articulated petals 27. Edge segment 45 defines about three-quarters of a full ellipse or oval; and, when the petals 27 are folded and secured as shown in FIG. 3, the distal edges of the folded petals substantially fill out the full ellipse or oval albeit such distal edges are in fact straight edges rather than being true curved segments of either an ellipse or an oval. That is, the distal edges are chords of slightly curved segments.

In FIG. 3, bib 20 is shown with petals 27 folded under and with their distal ends secured to their proximal ends: ie, with their edges 47, FIG. 2, generally aligned with the bases of slits 28. Thus, opening 43, FIG. 2, has been enlarged to become neck-accommodating aperture 50, FIG. 3, which is defined by the segmented perimetric edge designated 31 which consists of edge segment 45, FIG. 2, and four ellipse-chord segments 51. Therefore, the neck-accommodating aperture 50 has a generally elliptical shape. However, as stated above, it is expressly intended to include elliptical-shape apertures as well as circular-shape apertures within the generic term oval-shape apertures.

Figure 4:
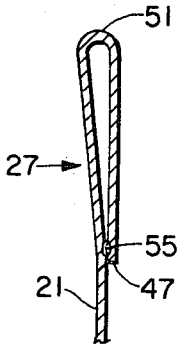
FIG. 4 is an enlarged scale, fragmentary sectional view taken along line 4—4 of FIG. 3.

FIG. 4 is a fragmentary enlarged scale view taken along line 4—4 of FIG. 3, and shows only the distal end 47 of a petal 27 secured by adhesive 55 to parent bib material of top panel 21. The ellipse-chord-shape edge 51 is also shown in FIG. 4 to be rounded which is preferred for user comfort albeit it is not intended to thereby limit the present invention. This construction provides petals 27 with resilient bumper characteristics due to the resilience of the bib material (ie, primarily the paper lamina) as opposed to unarticulated doubled under constructions which are stiffer by virtue of their face-to-face regions being secured together over their entire facing areas.

Figure 5:
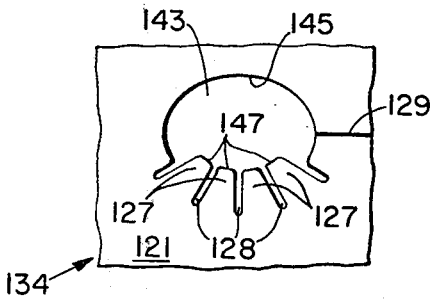
FIG. 5 is a fragmentary plan view of a die cut blank for making an alternate embodiment of the present invention.

FIG. 5 is a fragmentary view of an alternate embodiment blank 134 which is similar to blank 34, FIG. 2, except that blank 134 is provided with radially extended notches 138 in lieu of slits 28 in blank 34. Thus, in FIG. 5 (as well as in FIGS. 6 through 9 which also deal with alternate blank and bib embodiments) features which correspond to features of blank 34 and bib 20 are designated by numbers having the same last two digits: eg, top panel 121 of blank 134, FIG. 5, corresponds with top panel 21 of blank 34, FIG. 2. Thus, the pertinent features of blank 134 are designated petals 127, notches 128, slit 129, and edge segments 145 and 147 of opening 143.

Figure 6:
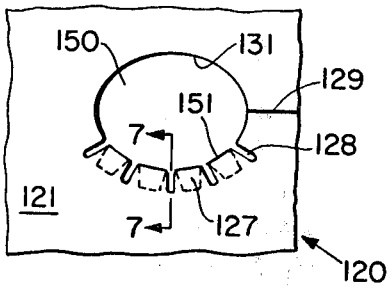
FIG. 6 is a fragmentary plan view of an alternate embodiment disposable bib made from a blank of the configuration shown in FIG. 5.
Figure 7:
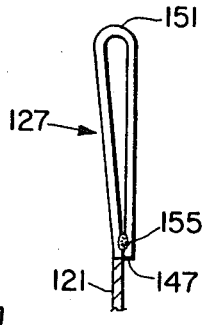
FIG. 7 is an enlarged scale, fragmentary sectional view taken along line 7—7 of FIG. 6.

Blank 134, FIG. 5, is converted to alternate bib 120, FIG. 6, by folding or doubling the distal ends of petals 127 under and securing their distal edges adjacent the bases of notches 128. This is best seen in FIG. 7—7 which is a fragmentary sectional view taken along line 7—7 of FIG. 6. Parenthetically, FIG. 7 corresponds to FIG. 4. However, whereas the base of a slit 28, FIG. 3, is not visible in FIG. 4, the base of a notch 128, FIG. 6, is inferred in FIG. 7 by the sectioned portion of top panel 121 and by the petal 127 not being sectioned.

As compared to bib 20, FIGS. 1 and 3, the radially extending notches 128 of bib 120 tend to make the construction more tear resistant.

Figure 8:
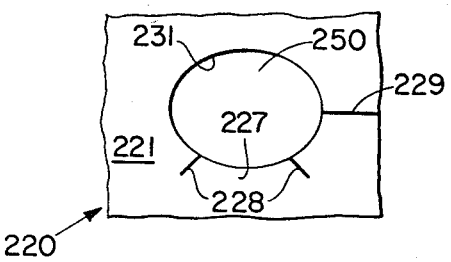
FIGS. 8 and 9 are fragmentary plan views of alternate bib embodiments of the present invention.
Figure 9:
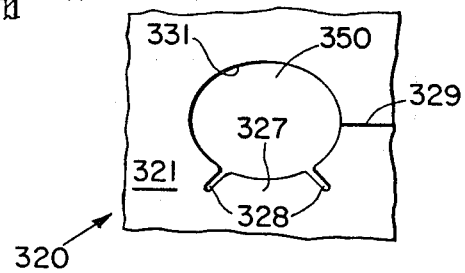

FIGS. 8 and 9 are fragmentary plan views of alternate bib embodiments which have been provided with elliptical-shape, neck-accommodating apertures 250 and 350, respectively, as well as radially extending slits 228 and notches 328, respectively. Additionally, these embodiments have shoulder slits 229 and 329, respectively, which are functionally equivalent to slits 228 and notches 328, respectively, insofar as enabling the portions adjacent the neck-accommodating apertures to conform to the users' neck. As compared to the foregoing embodiments, apertures 250 and 350 are die-cut to their finished shapes rather than achieving their finished shapes upon folding portions of the bib material under: ie, the distal portions of petals 27 and 127 as described above. Thus, whereas all of the bib embodiments of the present invention which have been described above have articulated, segmented perimetric edges, bibs 20 and 120 additionally obviate raw cut edges of the petals from contacting the users' neck. However, all articulate for user comfort and, due to material being removed to form the neck-accommodating apertures, obviate the bulkiness of bib embodiments wherein no bib material is removed to provide neck-opening means: reference the Background Art discussed above.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of this invention.

What is claimed is:

1. A bib of sheet material, said sheet material having a generally oval-shape neck accommodating aperture defined by a segmented perimetric edge, said perimetric edge being segmented by a plurality of bifurcations in said material which extend radially outwardly from said perimetric edge whereby said sheet material is rendered more conformant and compliant adjacent said neck-accommodating aperture.

2. The bib of claim 1 wherein said sheet material comprises a layer of paper having a basis weight of from about 16.3 to about 81.5 grams per square meter.

3. The bib of claim 2 wherein said layer of paper is a topsheet lamina of a laminate which further comprises a liquid impervious backsheet lamina.

4. The bib of claim 1 wherein each portion of said bib material which is disposed between two adjacent said bifurcations is denominated a petal having a distal end and a proximal end, said proximal end being attached to the body of said bib along an imaginary proximal-end-defining line which joins the bases of said two adjacent bifurcations, and wherein each said petal is folded so that its said distal end is disposed and secured adjacent its said proximal end.

5. The bib of claim 4 wherein only said distal end of each said petal is secured adjacent said proximal end and the remainder of the confronting surfaces of said petals are not secured together.

6. The bib of claim 4 wherein the back surfaces of the distal end portion and the proximal end portion of each petal are disposed in confronting relation.

7. The bib of claim 6 wherein only said distal end of each said petal is secured adjacent said proximal end and the remainder of the confronting surfaces of said petals are not secured together.

8. The bib of claim 1 wherein said bifurcations are slits in said sheet material.

9. The bib of claim 1 wherein said bifurcations are notches having radiused closed ends.

10. The bib of claim 1 wherein said bifurcations have lengths of about three centimeters or less.

* * * * *